US005224498A

United States Patent [19]

Deevi et al.

[11] Patent Number: 5,224,498

[45] Date of Patent: * Jul. 6, 1993

[54] ELECTRICALLY-POWERED HEATING ELEMENT

[75] Inventors: Seetharama C. Deevi, Midlothian; Francis M. Sprinkel, Glen Allen, both of Va.

[73] Assignee: Philip Morris Incorporated, New York, N.Y.

[ * ] Notice: The portion of the term of this patent subsequent to Mar. 3, 2009 has been disclaimed.

[21] Appl. No.: 803,174

[22] Filed: Dec. 5, 1991

Related U.S. Application Data

[63] Continuation of Ser. No. 444,569, Dec. 1, 1989, Pat. No. 5,093,894.

[51] Int. Cl.[5] ..... A61M 15/06

[52] U.S. Cl. ..... 131/194; 131/329; 131/273; 128/202.21; 128/202.27; 128/204.21; 128/204.13

[58] Field of Search ..... 131/329, 194, 273; 128/202.21, 202.27, 203.12, 203.13, 203.15, 204.21, 203.17, 203.26, 203.27, 204.13; 392/390, 395, 404

[56] References Cited

U.S. PATENT DOCUMENTS

| | | |
|---|---|---|
| 1,771,366 | 7/1930 | Wyss et al. . |
| 1,968,509 | 7/1934 | Tiffany . |
| 2,057,353 | 10/1936 | Whittemore, Jr. . |
| 2,104,266 | 1/1938 | McCormick . |
| 2,442,004 | 5/1948 | Hayward-Butt . |
| 2,974,669 | 3/1961 | Ellis . |
| 3,200,819 | 8/1965 | Gilbert . |
| 3,363,633 | 1/1968 | Weber . |
| 3,402,723 | 9/1968 | Hu . |
| 3,482,580 | 12/1969 | Hollabauch . |
| 3,496,336 | 2/1970 | Hingorany . |
| 3,591,753 | 7/1971 | Gartner . |
| 3,804,100 | 4/1974 | Fariello . |
| 3,889,690 | 6/1975 | Guarnieri . |
| 4,016,061 | 4/1977 | Wasa et al. . |
| 4,068,672 | 1/1978 | Guerra . |
| 4,077,784 | 3/1978 | Vayrynen . |
| 4,131,119 | 12/1978 | Blasutti . |
| 4,141,369 | 2/1979 | Burruss . |
| 4,164,230 | 8/1979 | Pearlman . |
| 4,193,411 | 3/1980 | Faris et al. . |
| 4,194,108 | 3/1980 | Nakajima . |

(List continued on next page.)

FOREIGN PATENT DOCUMENTS

| | | |
|---|---|---|
| 1202378 | 1/1989 | Canada . |
| 87/104459 | 2/1988 | China . |

(List continued on next page.)

OTHER PUBLICATIONS

Excerpt from "NASA Tech Briefs," Jul./Aug. 1988, p. 31.

"PTC Thermistors," Keystone Carbon Company product literature Jan. 1989.

U.S. patent application No. 07/222,961, Jul. 1988, Hayward et al.

U.S. patent application No. 07/443,636, Nov. 1989, Hajaligol et al.

*Primary Examiner*—V. Millin
*Assistant Examiner*—J. Doyle

[57] ABSTRACT

A heating element for use within a smoking device which is intended to be held in the lips of a consumer, and which, without burning, heats a flavor-generating medium within the device to produce an aerosol, vapor, or flavor, which the consumer may inhale. More particularly, an electrically-powered heating element having a plurality of discrete resistive heating segments, only one of which is active at any given time. In a preferred embodiment, the heating element is contained within the device so that the individual heating segments of the element are adjacent to a flavor-generating medium. As each segment of the heating element is provided with power, the flavor-generating medium adjacent to that segment is heated, but is not burned. This heating causes the flavor-generating medium to produce a flavor, aerosol, or vapor, which the consumer of the device may inhale.

29 Claims, 5 Drawing Sheets

U.S. PATENT DOCUMENTS 4,203,025 5/1980 Nakatani .
4,215,708 8/1980 Bron .
4,219,032 8/1980 Tabatznik et al. .
4,246,913 1/1981 Ogden et al. .
4,256,945 3/1981 Carter et al. .
4,259,564 3/1981 Ohkubo .
4,259,970 4/1981 Green, Jr. .
4,303,083 12/1981 Burruss, Jr. .
4,393,884 7/1983 Jacobs .
4,431,903 2/1984 Riccio .
4,436,100 3/1984 Green, Jr. .
4,463,247 7/1984 Lawrence et al. .
4,562,337 12/1985 Lawrence .
4,570,646 2/1986 Herron .
4,580,583 4/1986 Green, Jr. .
4,621,649 11/1986 Osterrath .
4,623,401 11/1986 Derbyshire et al. .
4,629,604 12/1986 Spector .
4,637,407 1/1987 Bonanno et al. .
4,659,912 4/1987 Derbyshire .
4,686,353 8/1987 Spector .
4,692,590 9/1987 Spector .
4,735,217 4/1988 Gerth et al. .
4,771,796 9/1988 Myer .
4,776,353 10/1988 Lilja et al. .
4,837,421 6/1989 Luthy .
4,846,199 7/1989 Rose .
4,848,376 7/1989 Lilja et al. .
4,874,924 10/1989 Yamamoto et al. .
4,877,989 10/1989 Drews et al. .
4,922,901 5/1990 Brooks et al. .
4,945,931 8/1990 Gori et al. .
4,947,874 8/1990 Brooks et al. .
4,947,875 8/1990 Brooks et al. .
4,966,171 12/1990 Serrano et al. .
4,981,522 1/1991 Nichols et al. .
4,991,606 2/1991 Serrano et al. .
5,040,552 8/1991 Nystrom et al. .
5,076,296 12/1991 Schleich et al. .
5,093,894 3/1992 Deevi ..... 392/390

FOREIGN PATENT DOCUMENTS 0295122 12/1988 European Pat. Off. .
0358002 3/1990 European Pat. Off. .
0358114 3/1990 European Pat. Off. .
3640917A1 8/1988 Fed. Rep. of Germany .
3735704A1 5/1989 Fed. Rep. of Germany .
61-68061 4/1986 Japan .
WO86/02528 5/1986 PCT Int'l Appl. .
2132539 6/1984 United Kingdom .
2148079 5/1985 United Kingdom .
2148676 5/1985 United Kingdom .

ELECTRICALLY-POWERED HEATING ELEMENT

This is a continuation of application Ser. No. 444,569, filed Dec. 1, 1989, now U.S. Pat. No. 5,093,894.

BACKGROUND OF THE INVENTION

The present invention provides a heating element for use within a smoking device, which is intended to be held in the lips of a consumer, and in which burning does not take place. More particularly, this invention relates to an electrically-powered heating element having a plurality of discrete electrically resistive heating segments, only one of which is active at any given time. The element is intended to heat a flavor-generating medium, which is contained within the device, without burning. As a result of this heating, the flavor-generating medium produces a flavored aerosol or vapor which the consumer may inhale.

Previously known conventional smoking devices deliver flavor and aroma to the user as a result of combustion. During combustion, a mass of combustible material, primarily tobacco, is oxidized as the result of applied heat (typical combustion temperatures in a conventional cigarette are in excess of 800° C. during puffing). During this heating, inefficient oxidation of the combustible material takes lace and yields various distillation and pyrolysis products. As these products are drawn through the body of the smoking device toward the mouth of the user, they cool and condense to form an aerosol or vapor which gives the consumer the flavor and aroma associated with smoking.

Such conventional smoking devices have various perceived drawbacks associated with them. Among these is the production of sidestream smoke which may be objectionable to non-smokers in the vicinity of the consumer of the device.

An alternative to conventional smoking devices are those in which the combustible material itself does not directly provide the flavorants to the aerosol or vapor inhaled by the user. In these devices, a combustible heating element, typically carbonaceous in nature, is ignited and used to heat air which is then drawn through a zone which contains some means for producing a flavored aerosol or vapor upon interaction with the heated air. While this type of smoking device produces little or no sidestream smoke, it still shares some characteristics with conventional cigarettes which are perceived as undesirable.

In both the conventional and carbon element heated smoking devices described above combustion takes place during their use. This process naturally gives rise to many by-products as the material supporting the combustion breaks down and interacts with the surrounding atmosphere.

Additionally, the combustion process which takes place in both of the aforementioned types of smoking devices cannot be easily suspended by the user in order to allow storage of the smoking device for later consumption. Obviously a conventional cigarette may be extinguished prior to its being smoked to completion, but if the user wishes to save the remaining portion of the cigarette for later use, the is faced with the problem of storing a relatively small, ash laden paper tube; convenient storage for such an item would most likely not be readily available. Users of the carbon element heated combustible smoking devices do not even have the option of extinguishing the device after it has been ignited, as the heating element contained within such devices is typically inaccessible to the user. Once lit, such carbon element smoking devices must be smoked to completion or discarded prior to completion while still burning.

Accordingly, it is the object of the present invention to provide for an electrically-powered heating element for use within an article, intended to be held in the lips of a consumer, which will heat a flavor-generating medium without burning. This flavor-generating medium, as a result of the heating, would produce a flavored aerosol or vapor which the consumer could then inhale. Furthermore, the heating element disclosed is configured so as to allow the consumer to operate the device in a puff by puff manner, with the option of suspending the operation of the device after any given puff, prior to the depletion of the device. The device could then be conveniently stored until some later time at which the consumer wished to resume operation.

SUMMARY OF THE INVENTION

This invention provides an electrically resistive linear heating element for use in a non-burning device. In a preferred embodiment the element consists of three component parts, namely a base region, an insulating region, and a heating region. Each heating region may consist of a single resistive heating segment, or be comprised of a plurality of electrically discrete resistive heating segments. In the former case, a plurality of heating elements would be used within a single device; in the latter, only a single heating element would be required.

In operation, the heating element would be contained within a device intended to be held in the lips of a consumer, and the resistive heating segments would be switchably connected to an electrical power source. Each element would be positioned within the device so that when power is supplied to a given resistive heating segment the heat produced by that segment would be transferred to a portion of a flavor-generating medium, thus heating the medium. When so heated, this flavor-generating medium would provide a flavored aerosol or vapor which the user of the device could inhale. The supply of electrical power to a given heating segment would be coincident with the user puffing the device. With each puff, a different heating segment within the device would be supplied with power, until all the segments within the device had been supplied with power once; at this point the device would be depleted. This switching of power between segments could be directly controlled by the user or triggered by control circuitry.

Smoking devices employing heating elements made in accordance with the principles of the present invention have certain advantages over combustion-type smoking devices. For example, such non-burning smoking devices give the user the sensation and flavor of smoking without actually creating some of the smoke components associated with combustion. This may allow the consumers of non-burning devices to enjoy the use of this device in areas where conventional smoking would be prohibited; such areas could include restaurants, offices, and commercial aircraft.

In addition, the elimination of burning from the process also prevents the creation of many of the by-products of burning. Because the heating element of the present invention never reaches a temperature which is sufficient to induce burning, such by-products are never produced.

A further advantage of this electrically-powered heating element is that it is very efficient in its utilization of electrical energy in heating the flavor-generating medium which provides the consumer with a flavored aerosol or vapor. The heating element is intended to receive electrical energy only during those periods when the device is being puffed, and only one heating segment is to be active during any given puff. This economy of energy consumption allows for a reduction in the amount of space which must be occupied by the element's power source, thus enabling a device in which the present invention is employed to be contained in a package which is comparable in size and shape to a conventional cigarette.

Moreover, the controllable nature of this invention allows the consumer to stop consuming the article prior to operating it to completion, and to continue consuming the article at some later time. Also, as only one heating segment within the device is active at any given time, the heat produced by the device at any given time remains relatively low. This low heat level allows the consumer to store a previously active, but unfinished device for later use, without concern as to the device's elevated temperature; the device may be stored almost immediately after it was last puffed. Such intermittent use and convenient storage is not practical with burning-type smoking devices.

Furthermore, the nature of the construction of the heating element lends itself to economical, continuous production using simple manufacturing methods.

BRIEF DESCRIPTION OF THE DRAWINGS

The above and other objects and advantages of this invention will be apparent on consideration of the following detailed description, taken in conjunction with the accompanying drawings, in which like reference characters refer to like parts throughout, and in which.

DETAILED DESCRIPTION OF THE INVENTION

Figure 1A:
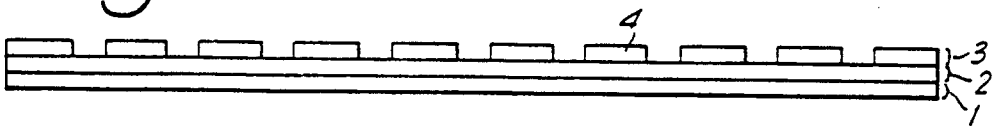
FIG. 1A is a side view of a three component embodiment of the electrically-powered heating element having a plurality of individual heating segments.
Figure 1B:
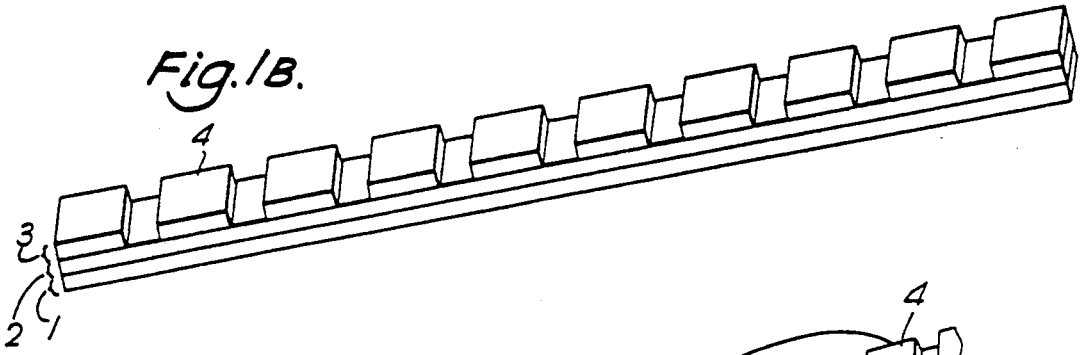
FIG. 1B is a perspective view of the embodiment of the electrically-powered heating element of FIG. 1A.

A preferred embodiment of the linear heating element is shown in FIGS. 1A and 1B. It comprises three planar component regions; namely a base region 1, an insulating region 2, and a heating region 3.

In this three component embodiment the base region 1 provides for the physical support of the insulating and heating regions. The base region in this particular embodiment includes a metallic tape, such as aluminum foil tape. The tape, while being rigid enough to physically support the insulating and heating regions, can be flexible enough to facilitate easy handling and resist fracturing during the manufacturing process. The metallic nature of the base region provides for the thermal stability of the heating element as most metals will not substantially deform or become chemically reactive at temperatures such as those encountered when the heating element is active.

Adjoining the base region, and physically separating it from the heating region, is the insulating region 2. This insulating region must have a sufficiently low electrical conductivity so as to isolate the electrically resistive heating region from the electrically conductive metallic base region. Like the base region, the insulating region must be thermally stable at the elevated temperatures which the active heating element would produce. In addition, this region should have a sufficiently high heat capacity so as to sink and buffer undesirable heat pulses which may be inadvertently produced by the heating region. This buffering prevents the flavor-generating medium from burning, which could detrimentally affect flavor and aerosol or vapor delivery. The insulating region can be fabricated using metallic oxides, metallic nitrides metallic carbides, metallic silicides, nonmetalilc oxides, nonmetallic nitrides, nonmetallic carbides, nonmetallic silicides, metallic carbonitride, an inter-metallic compound, a cermet, or an alloy of more than one metal. This region can also be composed of a combination of the elements of the previously mentioned list, to achieve the non-conducting, thermally-insulating, and structural properties needed for operation.

Such materials maybe fabricated separately and then joined with the base material or applied to the base materials as a fabrication step: by a coating process, a dip, mechanical pressing, slip casting, tape casting, extrusion, chemical vapor deposition, thermal spraying, plasma spraying, or any other method of pyrolytical or chemical deposition.

Figure 1C:
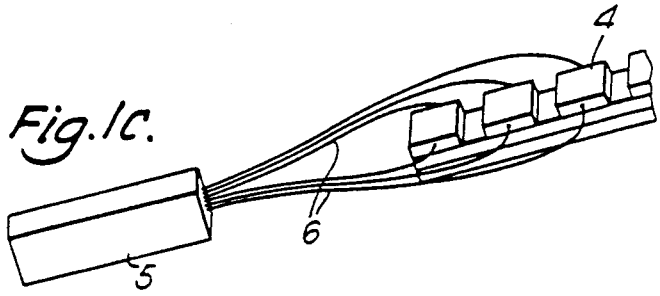
FIG. 1C is a perspective view of a portion of the heating element of FIG. 1A showing the connection of the individual heating segments to an electrical power source and switching means.

Situated adjacent to the insulating region and opposite the base region is the heating region 3. In this particular embodiment the heating region is not continuous in nature, rather it is comprised of a plurality of electrically discrete resistive heating segments 4. Each of the heating segments is situated so that it may be switchably connected to a power source in a manner which would allow current from the power source to be directed through a given segment thereby heating it. This switching of power to a particular segment could be directly controlled by the user or triggered by control circuitry. As illustrated in FIG. 1C, the connection between the heating segments 4 and an electrical power source and switching means 5 (such means includes any control circuitry) could be facilitated by conventional wires 6 attached to each of the segments. The resistivity of an individual heating segment must be such that when current flows through a given segment a temperature sufficient to induce the flavor-generating medium to produce an aerosol or flavor or vapor is achieved; typically this temperature is between about 100° C. and 600° C., preferably between about 250°-500° C. and most preferably cannot be so high as to impede the heating of the flavor-generating medium, using multiple batteries. Nor can it be so low that the power consumption requirement of the segment exceeds the capacity of the source. Typically, heating segments having resistances between 0.2 and 20.0 ohms, and preferably between 0.5 and 1.5 ohms, and most preferably between 0.8 and 1.2 ohms, can achieve such operating temperatures when connected across a potential of between 2.4 and 9.6 volts.

Throughout their range of operating temperatures, the heating segments must be chemically non-reactive with the flavor-generating medium being heated, so as not to adversely affect the flavor or content of the aerosol or vapor produced by the flavor-generating medium. The heating segments may be composed of carbon, graphite, carbon/graphite composites, metallic and non-metallic carbides, nitrides, silicides, inter-metallic compounds, cermets, alloys of metals, or Rare Earth and refractory metal foils, and may be deposited using any of the methods which were previously specified as being suitable for the deposition of the insulating region. Alternatively, they may be fabricated separately and laminated or otherwise assembled. Different materials can be mixed to achieve the desired properties of resistivity, mass, thermal conductivity and surface properties. The preferred materials are graphite-carbon composites.

Figure 2A:
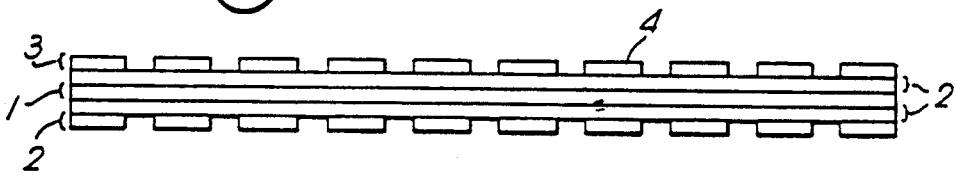
FIG. 2A is a side view of a five component embodiment of the electrically-powered heating element having a plurality of individual heating segments.
Figure 2B:
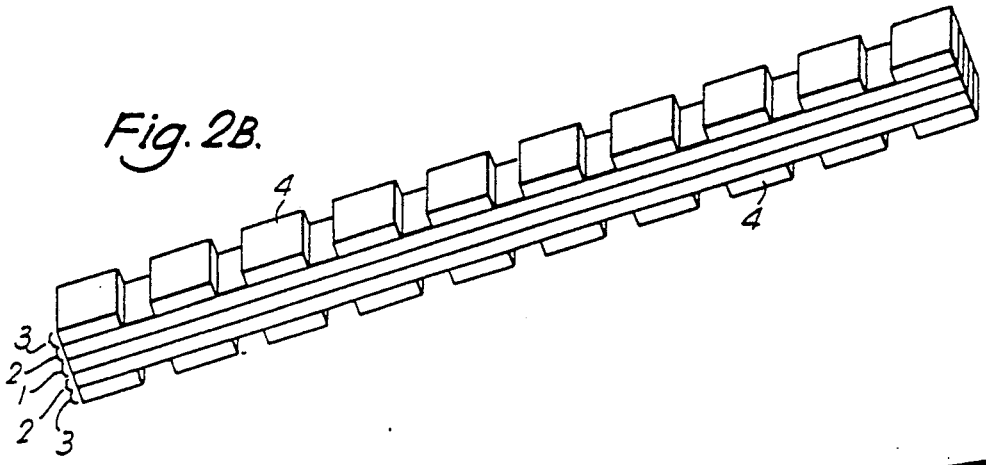
FIG. 2B is a perspective view of the embodiment of the electrically-powered heating element of FIG. 2A.

An additional preferred embodiment is shown in FIGS. 2A and 2B. A base region 1 is adjoined on two opposing sides by insulating regions 2, and a heating region 3 is situated adjacent to each of these insulating regions and opposite the base region. As in the previously described embodiment, each of the heating regions is comprised of a plurality of electrically-discrete resistive heating segments 4. Each of these component regions is similar in composition, fabrication, and physical characteristics to the like named regions which were disclosed in the description of the first embodiment. The operation of this five component embodiment of the heating element is primarily the same as that of the three component embodiment. The heating segments would be connected to a power source and switching means by conventional wires, as in the previously described three-component embodiment, with the exception that in the instant embodiment the heating segments would be switchably connected to a power source and switching means in a manner where two segments would be active at a given time. During a puff, power would be supplied to a pair of heating segments, one in each of the two heating regions. Such a two-sided heating element would increase to an active heating segment during a puff.

Figure 3:
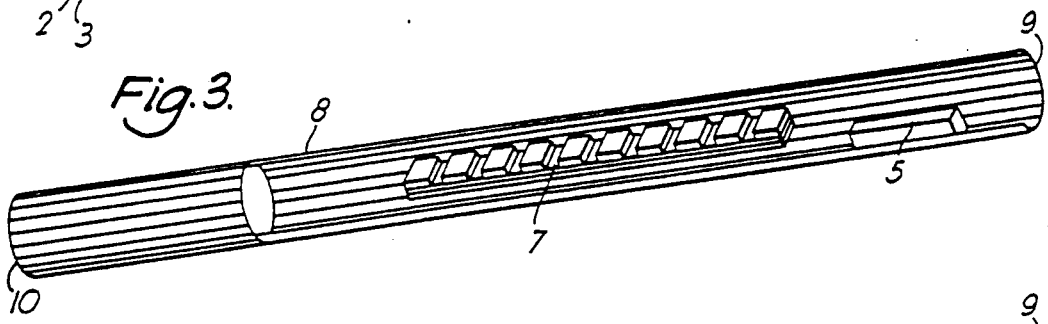
FIG. 3 is a partial cutaway perspective view of a the embodiment of the electrically-powered heating element of FIG. 1A, and an electrical power source and switching means positioned within a device.

All of the embodiments of the heating element which have been heretofore described may be situated within a cylindrical device having an outside diameter of between 6 and 18 millimeters. As shown in FIG. 3, the heating element 7 is mounted axially within the body 8 of a device in such a manner as to allow the consumer of the device to draw air from the far end 9 of the device, causing the air to pass over the element, and exit at the mouthpiece end 10 of the device. The power source and switching means 5 for the element is shown to be attached to the interior wall of the device in a manner which would not interfere with the flow of air through the device (for the sake of visual clarity, the wiring connecting the power source and switching means and the individual heating segments is not shown).

Figure 4:
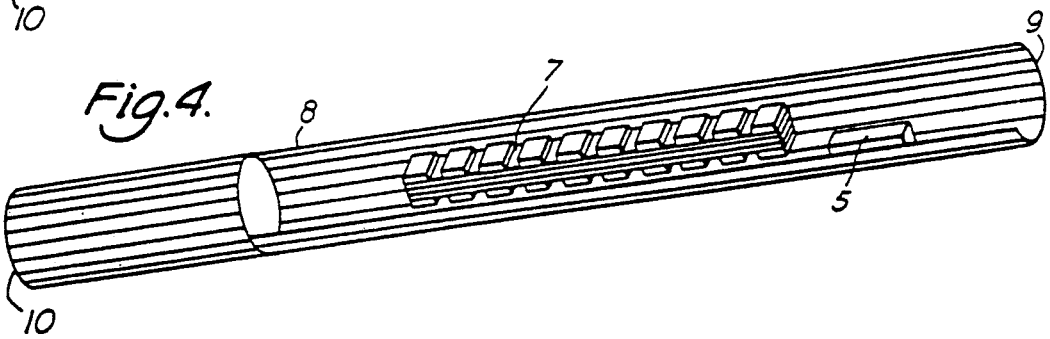
FIG. 4 is a partial cutaway perspective view of the embodiment of the electrically-powered heating element of FIG. 2A, and an electrical power source and switching means positioned within a device.

FIG. 4 shows a five component segmented heating element 7 similarly situated within a smoking device 8. Again the consumer may draw air from the far end 9 of the device, past the power source and switching means 5, over the element 7, and out of the mouthpiece end 10 of the device (as in FIG. 3, the wiring connecting the power source and switching means and the individual heating segments is not shown). In an alternative embodiment, air can also enter through the outside wall of the device, pass around the heater array, and then exit the mouth end 10.

Although all regions have been shown in the figures as being planar and rectangular, they may also be curled or spiral, to achieve the required surface area for heating within the size of the device.

Figure 5A:
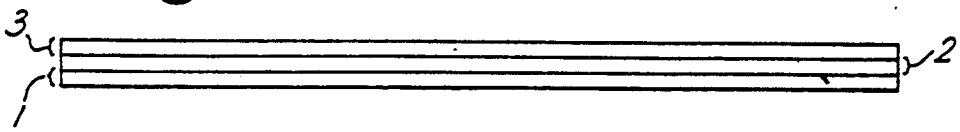
FIG. 5A is a side view of a three component electrically-powered heating element having a singular heating segment.
Figure 5B:
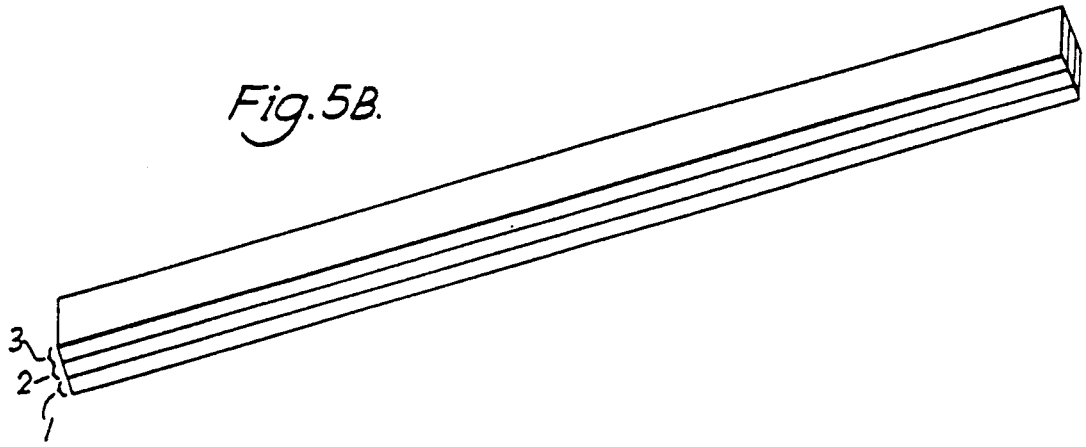
FIG. 5B is a perspective view of the embodiment of the electrically-powered heating element of FIG. 5A.

Yet another preferred embodiment of the linear heating element is shown in FIGS. 5A and 5B. It includes three planar component regions; namely a base region 1, an insulating region 2, and a heating region 3. In this three-component embodiment, the base region 1, the insulating region 2, and the heating region 3 are similar in composition and function to the like-named regions in the previously described embodiments. However, the heating region is comprised of a singular, continuous, electrically resistive area, as opposed to a plurality of discrete resistive heating segments.

Figure 6A:
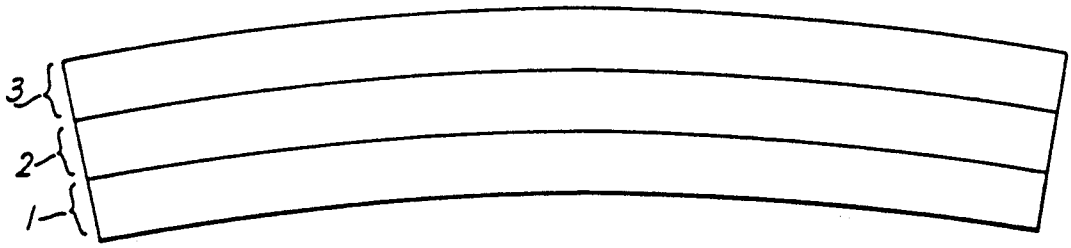
FIG. 6A is a front view of an alternate embodiment of a three component electrically-powered heating element having a singular heating segment.
Figure 6B:
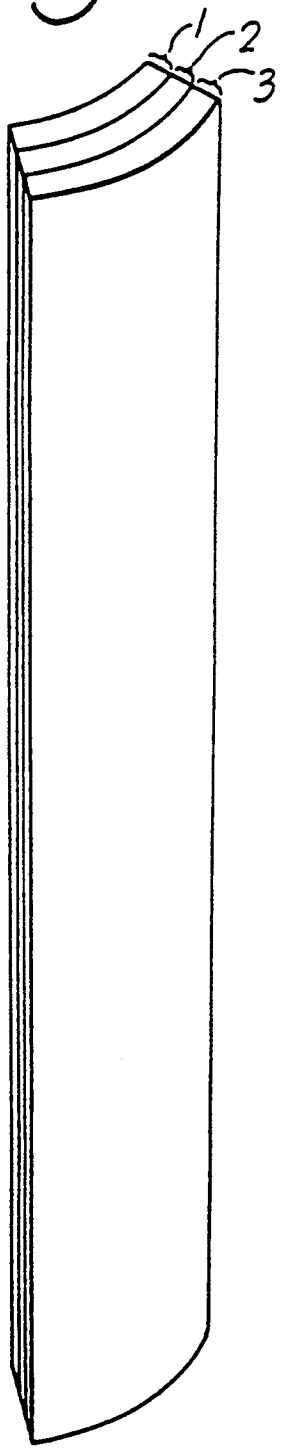
FIG. 6B is a perspective view of the embodiment of the electrically-powered heating element of FIG. 6A.

FIGS. 6A and 6B show an alternative preferred embodiment of the heating element, which is identical in all respects to the above described embodiment, except that the component regions are arched rather than planar in nature.

Figure 7A:
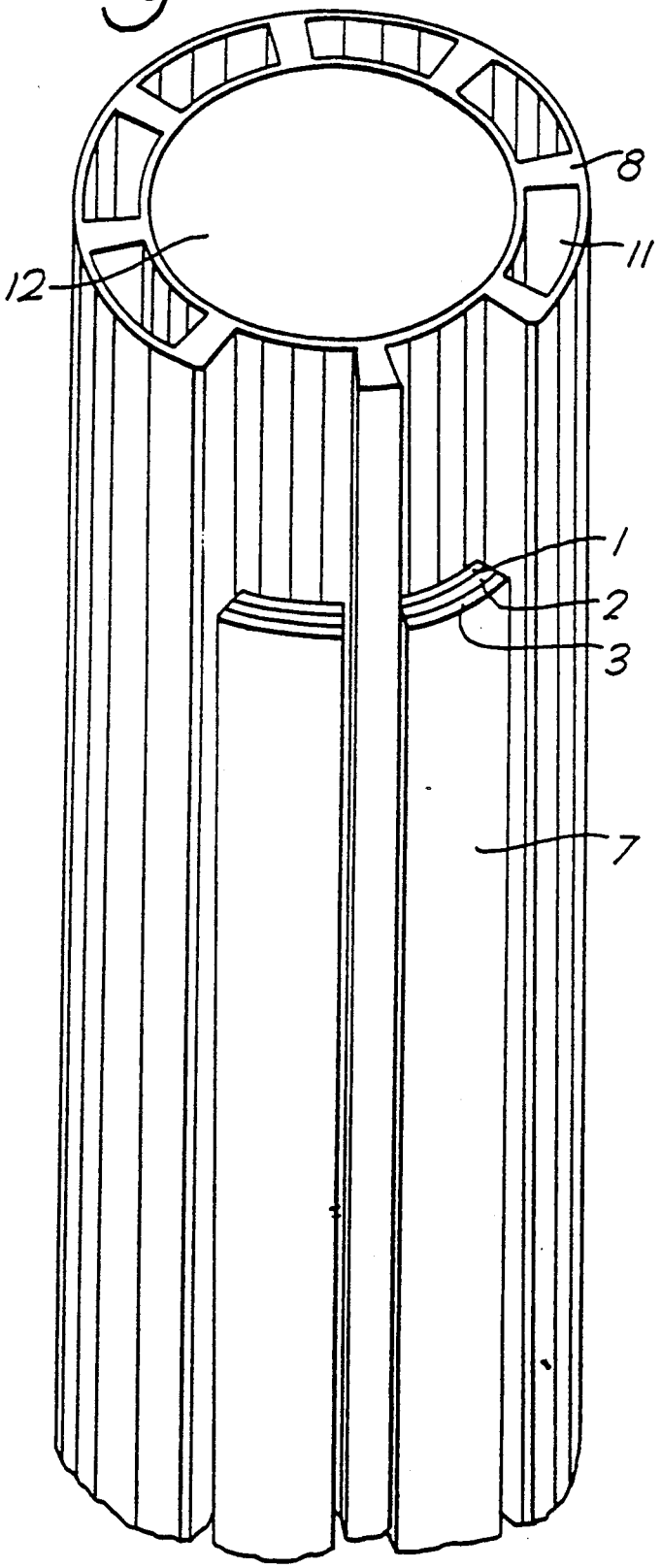
FIG. 7A is a partial cutaway perspective view of a portion of a smoking device showing the electrically-powered heating element of FIG. 6A positioned within.
Figure 7B:
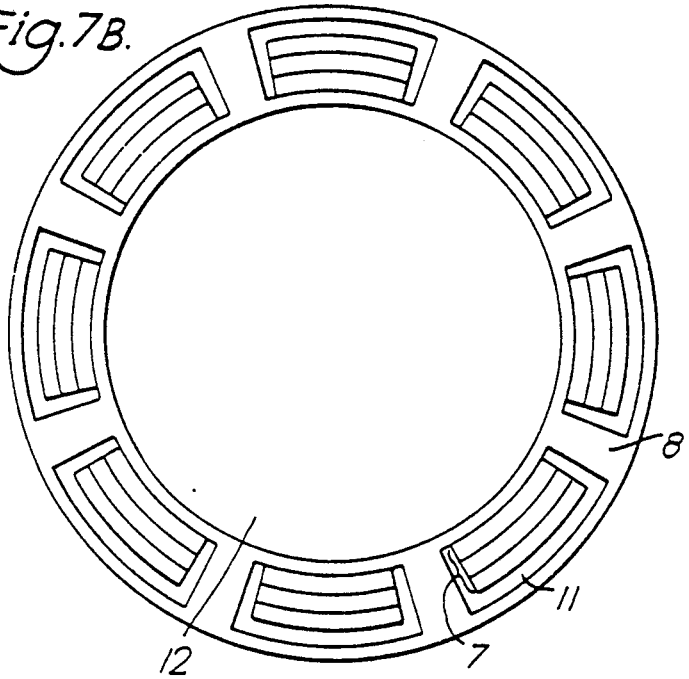
FIG. 7B is a front view of the embodiment of the electrically-powered heating element of FIG. 6A positioned within a device.

The embodiments of the heating element which have a single resistive heating segment may be employed within a device which is similar in size and shape to a conventional cigarette. As pictured in FIG. 7A, a plurality of these heating elements 7 are situated radially within the body of device 8 in such a manner as to allow the user of the device to draw air from the far end of the device, or through the exterior wall, into channels 11, which allow the air to pass over the elements before exiting at the mouthpiece end of the device. The power source and switching means for the element could be housed anywhere within the central core 12 of the device, without regard to obstructing the air flow through the device (such flow is facilitated by the channels 11 within the body of the device 8). FIG. 7B is cross-sectional view of such a smoking device showing the base region 1, insulating region 2 and heating region 3 of the heating elements 7, which are radially arranged within the body of the device 8.

In all of the previously described embodiments, the base region has been a metallic tape; however, in any of the above embodiments, this region could alternately be comprised of a foam mat, or a woven or non-woven fiber mat. Materials such as graphite, carbon, a metallic carbonitride, silicon dioxide, silicon carbide, or alumina could be used to fabricate the base region mat. The mat, while being rigid enough to physically support the heating and insulating regions, can be flexible enough to facilitate easy handling and resist fracturing during the manufacturing process. In addition, the base region mat must be thermally stable at high temperatures to ensure that it will not react with the neighboring heating region or decompose at elevated temperatures produced when the heating element is active.

When employed as a base region, a mat provides certain advantages over a solid tape. Unlike a tape, the mat is comprised of either a large number of individual fibers (with voids existing between those fibers), or a foam having many minute voids located throughout its structure. By impregnating the mat with a flavor-generating medium, thus filling the voids in that mat with the flavor-generating medium, a relatively large amount of the flavor-generating medium may be brought within close proximity of the resistive heating segments of the heating element. Such an arrangement would promote the efficient heating of the flavor-generating medium. The fibers or foam structure of the base region would provide an effective means of channeling the heat produced by the resistive heating segments to the flavor-generating medium, while at the same time sinking some of the heat so as to buffer the flavor-generating medium from any undesirable heat pulses, which might otherwise result in the burning of the flavor-generating medium.

Figure 8A:
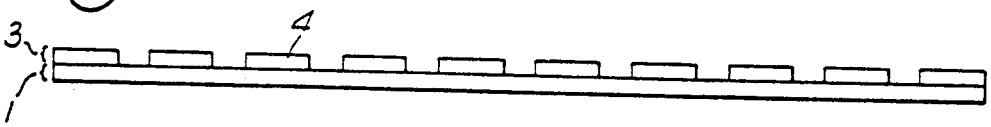
FIG. 8A is a side view of a two component embodiment of the electrically-powered heating element having a plurality of individual heating segments.
Figure 8B:
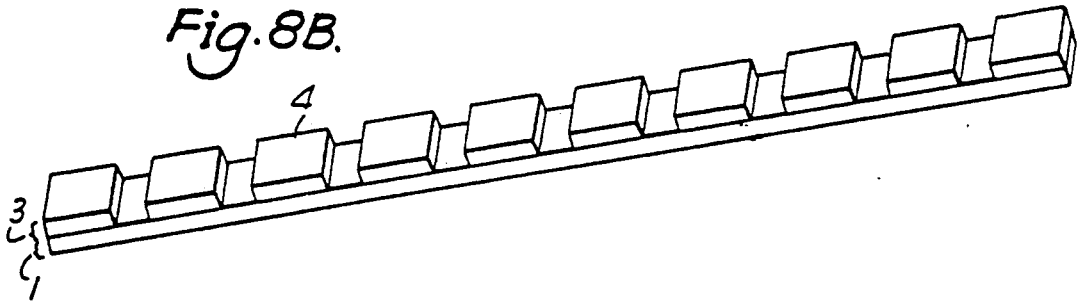
FIG. 8B is a perspective view of the embodiment of the electrically-powered heating element of FIG. 8A.

In any of the above described embodiments, regardless of whether the base region was comprised of a tape or a mat, the insulating region could be eliminated if the base region were to be fabricated from a material which would permit the heating segments to be placed in direct contact with it. That is to say, the base material would have to remain chemically and physically stable when directly exposed to the elevated temperatures of the active heating segments. In addition, such a base material would have to have a low enough electrical conductivity so as to insure that the individual heating segments remained electrically isolated from each other. The base region material would also have to exhibit a sufficiently high heat capacity so as to sink and buffer undesirable heat pulses which may be inadvertently produced by the heating region. However, it must not be so high as to impede the heating of the flavor-generating medium to a temperature sufficient to allow the production of an aerosol or vapor. This buffering would protect the flavor-generating medium from burning, which could detrimentally affect flavor and aerosol or vapor delivery. Alumina and other ceramic materials could be used to fabricate such a base region. Metallic and nonmetallic carbides, nitrides, silicides, oxides, metallic carbonitrides, inter-metallic compounds, and cermets (ceramic/metallic composites) can also be used to produce the mat material and to tailor the specific properties or resistivities, heat capacity, mass, surface area and texture for optimum performance. An example of such an embodiment is illustrated in FIGS. 8A and 8B. The heating region 3, composed of a plurality of discrete resistive heating segments 4, is adjacent to the base region 1.

Furthermore, in any of the above described embodiments, an additional protective region could be deposited which would envelop the heating region. Such a region would only be needed when the material which formed the heating region provided to be chemically reactive with the flavor-generating medium to be heated. This protective region would physically isolate the heating region from the flavor-generating medium, and would prevent any undesirable effects upon the flavor or content of the aerosol or vapor produced by the flavor-generating medium during heating. Naturally, the protective region must itself be formed of a material which is stable at elevated temperatures and chemically non-reactive with the flavor-generating medium. The protective region must also have a sufficiently low electrical conductivity so as not to compromise the electrical isolation of the discrete resistive heating segments. Finally, the thermal conductivity of such a protective region must be high enough to allow a sufficient quantity of heat to be transferred from each heating region to the flavor-generating medium to facilitate the production of an aerosol or vapor by the flavor-generating medium. The protective region could be fabricated from materials such as graphite, silicate glass, high-temperature vitreous enamel, metallic and nonmetallic oxides, carbides, nitrides, silicides, or metallic carbonitride, or cermet. Such materials may be applied to the heating element by a coating process, a dip, mechanical pressing, slip casting, tape casting, chemical vapor deposition, extrusion, thermal spraying, plasma spraying, or any other method of low temperature, pyrolytical, or chemical deposition.

It will be understood that the particular embodiments described above are only illustrative of the principles of the present invention, and that various modifications could be made by those skilled in the art without departing from the scope and spirit of the present invention, which is limited only by the claims that follow.

What is claimed is:

1. An electrically-powered heating element, enclosed within a device adapted to be supported by the lips of an individual, comprising:

a base member;

an electrically-resistive heating member switchably connectable to an electrical power source, said heating member having a resistivity which, when said heating member is connected to said power source, causes the heating member to attain a temperature sufficient to heat, without burning, a flavor-generating medium which is in thermal contact with said heating member; and an insulating member secured between the base member and the heating member, said insulating member having an electrical resistance sufficiently high to electrically isolate the heating member from the base member, said insulating member also having a thermal conductivity sufficiently low to thermally isolate the heating member from the base member.

2. The electrically-powered heating element of claim 1 wherein the electrically-resistive heating member comprises a plurality of electrically-discrete resistive segments, each of which is switchably and independently connectable to an electrical power source.

3. The electrically-powered heating element of claim 1 wherein the electrically-resistive heating member has a resistance of between 0.2 and 2.0 ohms.

4. The electrically-powered heating element of claim 3 wherein the electrically-resistive heating member has a resistance of between about 0.5 and 1.5 ohms.

5. The electrically-powered heating element of claim 4 wherein the electrically-resistive heating member has a resistance of between about 0.8 and 1.2 ohms.

6. The electrically-powered heating element of claim 1 wherein the heating element is of a size which could be contained within a smoking device having an outside diameter of between 6 and 18 millimeters.

7. An electrically-powered heating element, enclosed within a smoking device adapted to be supported by the lips of an individual, comprising:

a base member;

a pair of electrically-resistive heating members switchably connectable to an electrical power source, each of said heating members having a resistivity which, when each member is connected to said power source, causes each of the heating members to attain a temperature sufficient to heat a flavor-generating medium which is in thermal contact with said heating members without burning; and a pair of insulating members, each disposed along a respective side of the base member and secured to a respective one of the resistive heating members, said insulating members having an electrical resistance sufficiently high to electrically isolate the heating members from the base member, said insulating member also having a thermal conductivity sufficiently low to thermally isolate the heating member from the base member.

8. The electrically-powered heating element of claim 7 wherein each electrically-resistive heating member comprises a plurality of electrically-discrete resistive segments, each of which is switchably connectable to an electrical power source.

9. The electrically-powered heating element of claim 7 wherein the electrically-resistive heating member has a resistance of between 0.2 and 20.0 ohms.

10. The electrically-powered heating element of claim 9 wherein the electrically-resistive heating member has a resistance of between about 0.5 and 1.5 ohms.

11. The electrically-powered heating element of claim 10 wherein the electrically-resistive heating member has a resistance of between about 0.8 and 1.2 ohms.

12. The electrically-powered heating element of claim 7 wherein the heating element is of a size which could be contained within a smoking device having an outside diameter of between 6 and 18 millimeters.

13. The electrically-powered heating element of claims 1 or 7 wherein the base member comprises an element selected from the group consisting of metallic tape, metallic or nonmetallic oxide, carbides, nitrides, silicides, carbonnitrides, inter-metallic compounds, and cermet.

14. An electrically-powered heating element, enclosed within a smoking device adapted to be supported by the lips of an individual, comprising:

an electrically-resistive heating member switchably connectable to an electrical power source, said heating member having a resistivity which, when said heating member is connected to said power source, causes the heating member to attain a temperature sufficient to heat a flavor-generating medium which is in thermal contact with said heating member; and a base member secured to said heating member, said base member comprising an electrically-insulating material capable of maintaining its structural integrity and chemical inertness throughout the range of operating temperatures of the heating member.

15. The electrically-powered heating element of claim 14 wherein the electrically-resistive heating member comprises a plurality of electrically-discrete resistive segments, each of which is switchably and independently connectable to an electrical power source.

16. The electrically-powered heating element of claim 14 wherein the electrically-resistive heating member has a resistance of between 0.2 and 20.0 ohms.

17. The electrically-powered heating element of claim 16 wherein the electrically-resistive heating member has a resistance of between about 0.5 and 1.5 ohms.

18. The electrically-powered heating element of claim 17 wherein the electrically-resistive heating member has a resistance of between about 0.8 and 1.2 ohms.

19. The electrically-powered heating element of claim 14 wherein the heating element is of a size which could be contained within a smoking device having an outside diameter of between 6 and 18 millimeters.

20. An electrically-powered heating element, enclosed within a smoking device adapted to be supported by the lips of an individual, comprising;

a pair of electrically-resistive heating members switchably connectable to an electrical power source, each of said heating members having a resistivity which, when each member is connected to said power source, causes each of the heating members to attain a temperature sufficient to heat a flavor-generating medium in thermal contact with said heating members; and a base member, secured and interposed between each of said heating members, comprising an electrically-insulating material capable of maintaining its structural integrity and chemical inertness throughout the range operating temperatures of the heating members.

21. The electrically-powered heating element of claim 20 wherein each electrically-resistive heating member comprises a plurality of electrically-discrete resistive segments, each of which is switchably connectable to a power source.

22. The electrically-powered heating element of claim 20 wherein the electrically-resistive heating member has a resistance of between 0.2 and 20.0 ohms.

23. The electrically-powered heating element of claim 22 wherein the electrically-resistive heating member has a resistance of between about 0.5 and 1.5 ohms.

24. The electrically-powered heating element of claim 23 wherein the electrically-resistive heating member has a resistance of between about 0.8 and 1.2 ohms.

25. The electrically-powered heating element of claim 20 wherein the heating element is of a size which could be contained within a smoking device having an outside diameter of between 6 and 18 millimeters.

26. The electrically-powered heating element of claims 1, 7, 14, or 20 wherein the base member comprises a mat of non-woven fibers.

27. The electrically-powered heating element of claim 1, 7, 14, or 20 wherein the base member comprises a mat of woven fibers.

28. The electrically-powered heating element of claim 1, 7, 14, or 20 wherein the heating element is encased in a protective coating, said protective coating providing a physical and chemical barrier between the heating element and its surroundings, and being substantially chemically non-reactive with the other components of the heating element and with the environment in which the heating element is to be used.

29. The electrically-powered heating element of claims 1 or 7 wherein the base member comprises a metallic tape, and wherein the heating element is encased in a protective coating, said protective coating providing a physical and chemical barrier between the heating element and its surroundings, and also being substantially chemically non-reactive with the other components of the heating element and with the environment in which the heating element is to be used.

* * * * *